United States Patent [19]

Helms et al.

[11] 4,323,082

[45] Apr. 6, 1982

[54] APPARATUS FOR MAKING HOLES IN WEBS OF WRAPPING MATERIAL FOR CIGARETTES OR THE LIKE

[75] Inventors: Adolf Helms, Hamburg; Heinz-Christen Lorenzen, Wentorf, both of Fed. Rep. of Germany

[73] Assignee: Hauni-Werke Körber & Co. KG., Hamburg, Fed. Rep. of Germany

[21] Appl. No.: 179,422

[22] Filed: Aug. 19, 1980

[30] Foreign Application Priority Data

Aug. 23, 1979 [DE] Fed. Rep. of Germany ..... 2934045

[51] Int. Cl.[3] ..... A24C 5/60

[52] U.S. Cl. ..... 131/281; 219/384; 131/365

[58] Field of Search ..... 131/281, 365, 226; 219/384

[56] References Cited

U.S. PATENT DOCUMENTS

| | | | |
|---|---|---|---|
| 2,763,759 | 9/1956 | Mito et al. | 219/384 |
| 3,862,396 | 1/1975 | Machida et al. | 219/384 |
| 4,040,425 | 8/1977 | Goodling et al. | 219/384 |
| 4,207,458 | 6/1980 | Lilly et al. | 219/384 |
| 4,219,727 | 8/1980 | Bolt | 131/281 |
| 4,232,574 | 11/1980 | Hall | 131/336 |
| 4,236,062 | 11/1980 | Lilly et al. | 131/281 |
| 4,253,010 | 2/1981 | Brown et al. | 219/384 |

FOREIGN PATENT DOCUMENTS

| | | | |
|---|---|---|---|
| 2734643 | 8/1977 | Fed. Rep. of Germany | 131/281 |
| 2833527 | 2/1979 | Fed. Rep. of Germany | 131/281 |

*Primary Examiner*—V. Millin

*Attorney, Agent, or Firm*—Kontler & Grimes

[57] ABSTRACT

Apparatus for making holes in a running web of wrapping material in a filter tipping machine has a housing which defines an elongated passage for the running web and contains rows of first and second electrodes which are disposed at the opposite sides of the passage and define spark gaps forming part of the passage. When the web is drawn through the passage and the electrodes receive high voltage impulses from the secondary winding of a transformer, sparks which are caused to jump across the gaps burn holes in the running web with attendant heating of the electrodes as well as development of dust and ozone. The intake end of a conduit is connected to the housing to draw through the passage a stream of cool atmospheric air when a blower which is connected to the discharge end of the conduit is in operation. The air stream cools the electrodes to thereby prolong their useful life and to reduce the likelihood of charring of the web. Furthermore, the air stream withdraws from the housing particles of dust as well as ozone. The particles of dust are intercepted by a first filter which is installed in the conduit ahead of a second filter for separation of ozone so that dust cannot contaminate the second filter and the second filter prevents the ozone from reaching and corroding the blower.

13 Claims, 4 Drawing Figures

APPARATUS FOR MAKING HOLES IN WEBS OF WRAPPING MATERIAL FOR CIGARETTES OR THE LIKE

CROSS-REFERENCE TO RELATED APPLICATION

The apparatus of the present invention includes component parts, some of which are similar in the apparatus disclosed in the commonly owned copending application Ser. No. 179,687 filed Aug. 20, 1980 by Peter Pinck et al. for "Method and apparatus for treatment of wrapping material for cigarettes or the like".

BACKGROUND OF THE INVENTION

The present invention relates to apparatus for perforating wrapping material for cigarettes, filter rod sections or analogous rod-shaped articles which constitute or form part of smokers' products. More particularly, the invention relates to improvements in apparatus for making holes in webs, sheets, strips or like bodies of wrapping material by resorting to electrodes which define one or more spark gaps. Still more particularly, the invention relates to improvements in apparatus wherein the wrapping material is in motion during exposure to the action of perforating means and which can perforate wrapping material for use in machines which manufacture and/or process rod-shaped articles which constitute or form part of smokers' products.

It is already known to make holes in a running web of wrapping material for cigarettes or the like by resorting to one or more pairs of electrodes which define one or more spark gaps and by causing the running web to pass through such spark gap or gaps while the electrodes generate sparks which burn holes into the wrapping material therebetween. It is advisable to install the perforating apparatus directly in a machine which makes and/or processes cigarettes or the like because this renders it possible to adjust the perforating apparatus in response to signals which are generated during testing of finished products in the machine proper, e.g., during testing of the wrappers and/or tobacco-containing ends of filter cigarettes and/or during testing of the resistance of filter cigarettes to axial flow of gaseous fluid therethrough. Thus, if a perforating apparatus is installed directly in a filter tipping or like machine, its perforating action can be adjusted in immediate response to detection of articles whose wrappers exhibit excessive or insufficient permeability to the flow of a gaseous fluid therethrough. The reason for making holes in the webs of wrapping material for cigarettes or the like is that many manufacturers attribute highly beneficial effects to atmospheric air which can flow through the perforations of the wrapping material to be mixed with the column of tobacco smoke before such column reaches the smoker's mouth and lungs. The admixed atmospheric air is supposed to reduce certain deleterious effects of nicotine and/or condensate in tobacco smoke.

It has been found that many presently known perforating apparatus which resort to pairs of electrodes (i.e., which rely on the generation of sparks for the making of holes in a running web of cigarette paper or the like) cannot be installed in a filter tipping or like machine for a variety of reasons. Thus, an electrically operated perforating apparatus generates relatively large quantities of dust which develop as a result of combustion of wrapping material in the spark gaps between neighboring electrodes. Moreover, such mode of making holes in cigarette paper or the like entails the development of substantial quantities of ozone which can exert an adverse influence on the health of the attendants. Still further, improper operation of such apparatus can result in charring or total combustion of the running web of wrapping material.

OBJECTS AND SUMMARY OF THE INVENTION

An object of the invention is to provide a novel and improved perforating apparatus which can be readily installed directly in a machine for the manufacture and/or processing of cigarettes or the like in spite of the fact that the apparatus is operated electrically and its operation entails the development of dust and/or ozone.

Another object of the invention is to provide a relatively simple, compact and inexpensive electrically operated perforating apparatus which can be installed in existing filter tipping and/or other machines for the manufacture and/or processing of rod-shaped articles which constitute or form part of smokers' products.

An additional object of the invention is to provide an apparatus of the above outlined character which does not contribute to complexity of a producing or processing machine and does not adversely influence the accessibility of other components of such machine.

A further object of the invention is to provide an apparatus whose operation does not entail any danger to the health and/or comfort of attendants in the building in which the machine embodying or cooperating with the apparatus is installed.

An ancillary object of the invention is to provide an apparatus which does not contribute to rapid contamination of a machine or in combination with which the apparatus is put to use.

Another object of the invention is to provide a perforating apparatus which can stand long periods of uninterrupted use, whose components are not likely to undergo excessive wear in spite of the fact that the making of holes in wrapping material is the result of generation of sparks which, in turn, entail the development of heat, ozone and dust, and which requires a minimum of attention and/or maintenance so that it is not likely to cause frequent and/or prolonged interruptions in operation of the machine or machines in or in combination with which the apparatus is put to use.

The invention is embodied in an apparatus for making holes (preferably minute perforations which form one or more rows) in a running web of wrapping material (e.g., cigarette paper or imitation cork) in a machine for the manufacture and/or processing of rod-shaped articles which constitute or form part of smokers' products (such machine may constitute a filter tipping machine, a cigarette maker, a filter rod making machine or the like). The apparatus comprises a housing which defines a preferably elongated passage (e.g., a relatively narrow slot) for the running web, a suction drum or other suitable means for transporting the web through the passage of the housing, first and second electrode means installed in the housing and defining at least one spark gap which forms part of the passage so that the running web advances through the gap between the first and second electrode means, a transformer or other suitable means for applying high voltage impulses to the electrode means and for thereby inducing the flow of a current across the spark gap with attendant generation of sparks which burn holes in the running web and cause the development of dust and ozone, and means for drawing a stream of atmospheric air through the passage whereby the stream cools the electrode means and removes dust and ozone from the passage (i.e., from the housing). The means for drawing such stream preferably includes conduit means having an intake end communicating with the passage and a discharge end which is connected to a suction generating device (e.g., to the inlet of a blower) also forming part of the stream drawing means. The apparatus further comprises a dust filter or other suitable dust intercepting means which is installed in the conduit means, and ozone separating means (e.g., an activated charcoal filter) which is also installed in the conduit means, preferably between the dust intercepting means and the suction generating means.

In accordance with a presently preferred embodiment, the apparatus further comprises means for monitoring the pressure of air in the conduit means, preferably between the intake end and the dust intercepting means, and for generating signals when the pressure of air in the conduit means is outside of a predetermined range, namely, a range which is acceptable for satisfactory cooling of the electrode means and for removal of all or nearly all dust and ozone from the housing. Such signals can be transmitted to a control unit for the source (e.g., the aforementioned transformer) of high voltage impulses, and the control means then interrupts the transmission of impulses to the electrode means until the cause of unsatisfactory air pressure in the conduit means is eliminated.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain specific embodiments with reference to the accompanying drawing.

DESCRIPTION OF THE PREFERRED EMBODIMENTS

Figure 1:
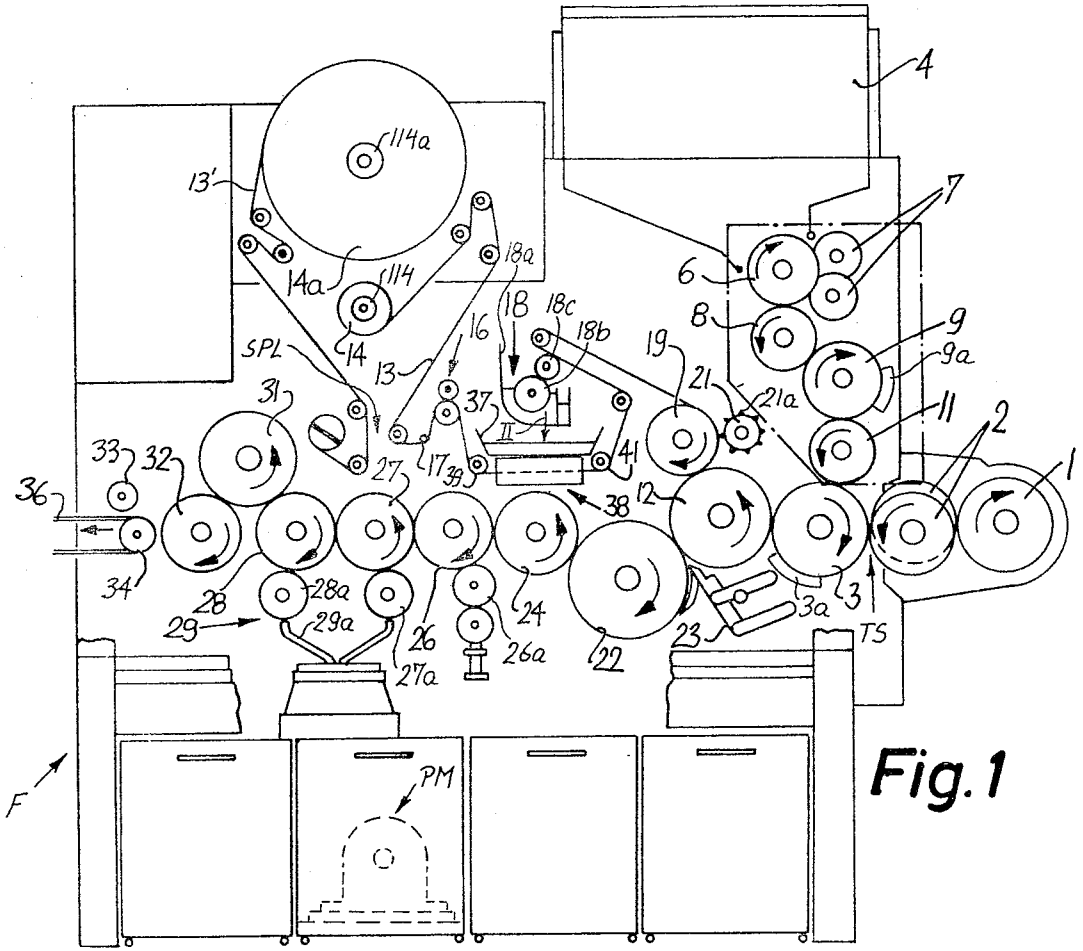
FIG. 1 is a schematic front elevational view of a filter tipping machine embodying a perforating apparatus which is constructed and assembled in accordance with the invention.

FIG. 1 shows a filter tipping machine of the type known as MAX S (produced by the assignee of the present application). The filter tipping machine is directly coupled to a cigarette maker, e.g., to a machine known as GARANT (produced by the assignee of the present application). The link between the maker and the filter tipping machine is a rotary drum-shaped row forming conveyor 1 which has peripheral flutes receiving plain cigarettes of unit length from the outlet of the cigarette maker. Plain cigarettes which enter the flutes of the conveyor 1 form two rows whose constituents are respectively located in the evenly and oddly numbered flutes. The cigarettes of one row are nearer to one axial end and the cigarettes of the other row are nearer to the other axial end of the conveyor 1. The latter transports the two rows of cigarettes sideways and admits the cigarettes of one row into successive flutes of a first rotary drum-shaped aligning conveyor 2. The cigarettes of the other row are transferred into successive flutes of a second rotary drum-shaped aligning conveyor 2. The conveyors 2 are driven at different speeds and/or transport the plain cigarettes of the respective rows through different distances so that successive cigarettes of one row enter successive flutes of a rotary drum-shaped assembly conveyor 3 simultaneously with successive cigarettes of the other row. The cigarettes which enter a flute of the assembly conveyor 3 are coaxial to each other but are spaced apart by a distance which at least equals the length of a filter plug of double unit length.

The frame F of the filter tipping machine further supports a magazine 4 for a stack of parallel filter rod sections of six times unit length. The outlet of the magazine 4 is adjacent to a rotary drum-shaped severing conveyor 6 which has peripheral flutes each of which withdraws from the magazine 4 a filter rod section of six time unit length. Such sections are transported clockwise, as viewed in FIG. 1, past two rotary disk-shaped knives 7 which subdivide each section into three portions or plugs of double unit length. The sets of three coaxial filter plugs each are transferred into the peripheral flutes of three rotary disk-shaped components of a staggering conveyor 8 whereon the plugs of each set are shifted, as considered in the circumferential direction of the conveyor 8, prior to being transferred into successive peripheral flutes of a rotary drum-shaped shuffling conveyor 9. The latter cooperates with stationary cams **9*a* to move some or all of the plugs axially so that the shuffled plugs form a single row wherein each preceding plug is in exact register with the next-following plug. Successive plugs of the thus obtained row are transferred into successive peripheral flutes of a rotary drum-shaped accelerating conveyor 11 which delivers successive plugs into successive flutes of the assembly conveyor 3 in such a way that each freshly transferred plug occupies the space between the spaces reserved for the pairs of plain cigarettes which are delivered by the aligning conveyors 2. Thus, each flute of the assembly conveyor 3 which has advanced beyond the transfer station TS between the conveyor 3 on the one hand and the aligning conveyors 2 on the other hand contains a group of three coaxial rod-shaped articles including a pair of coaxial but spaced apart plain cigarettes of unit length and a filter plug of double unit length therebetween. Such groups thereupon advance between two stationary cams 3*a*** which shift one or both plain cigarettes of each group axially so that each of the resulting condensed groups contains a centrally located filter plug and two plain cigarettes whose inner end portions abut against the respective end faces of the aligned filter plug.

The condensed groups of rod-shaped articles are delivered into successive flutes of a rotary drum-shaped transfer conveyor 12 which cooperates with a rotary suction drum 19. The peripheral surface of the drum 19 is formed with suction ports which attract uniting bands during transport of such bands toward the transfer station between the drum 19 and the transfer conveyor 12.

The uniting bands are obtained by subdividing a web 13 of cigarette paper, imitation cork or other suitable wrapping material. The web 13 is withdrawn from a bobbin 14 which is mounted on a spindle 114. On its way from the bobbin 14 toward the periphery of the suction drum 19, the web 13 advances past a so-called curling device 17 which eliminates eventual localized stresses in the web. A suitable curling device is disclosed in commonly owned U.S. Pat. No. 3,962,957 granted June 15, 1976 to Alfred Hinzmann. The web 13 thereupon advances along a paster 18 comprising a tank **18*a* for a supply of an aqueous dispersion of hotmelt, a withdrawing wheel 18*b* which dips into the supply of adhesive in the tank 18*a* so that its peripheral surface withdraws a continuous film of liquid adhesive, and a roller-shaped applicator 18*c* which transfers the film of adhesive from the periphery of the wheel 18*b* to the underside of the adjacent portion of the running web 13. On its way from the curling device 17 whose sharp edge engages and flexes successive increments of the web 13, the latter advances through the nip of two transporting rolls 16 which draw the web off the bobbin 14**.

The configuration of the periphery of the applicator **18*c* may be such that the latter transfers to the adjacent side of the web 13 two relatively wide strips or layers of liquid adhesive. Such layers are separated from each other by a centrally located uncoated portion. Each of the layers extends all the way to the respective margin of the web 13. The width of the layers is constant, i.e., the width of the uncoated portion is also constant as long as the width of the web 13 matches a desired value. Reference may be had to the aforementioned copending patent application Ser. No. 179,687 of Pinck et al. The liquid adhesive in the tank 18*a* of the paster 18 is or can be an aqueous dispersion of a copolymer of ethylene vinyl acetate. The layers of liquid adhesive which are applied to the marginal portions of the web 13** are preferably thin, e.g., their thickness may be in the range of 10–15 micrometers, preferably approximately 12 micrometers. When the liquid adhesive sets, its thickness is approximately one-half the thickness of the liquid layers (i.e., in the range of approximately 6 micrometers).

The drum 19 forms a part of a severing unit which further includes a roller 21 carrying a set of knives **21*a* which sever the leader of the web 13 at regular intervals so that the web yields a succession of uniting bands each carrying (at one of its sides) one or more layers of adhesive. The uniting bands are attached to successive groups of rod-shaped articles in the oncoming flutes of the transfer conveyor 12. Each uniting band is applied to the respective group in such a way that it contacts the corresponding filter plug of double unit length as well as the adjacent inner end portions of the associated plain cigarettes of unit length. The transfer conveyor 12 delivers successive groups (each of which carries a uniting band) onto the periphery of a rotary drum-shaped draping conveyor 22 cooperating with a stationary or mobile draping or rolling device 23** to convert each uniting band into a tube which surrounds the corresponding filter plug as well as the adjacent end portions of the aligned plain cigarettes, i.e., each such group is converted into a filter cigarette of double unit length.

The uniting bands are converted into the aforementioned tubes during travel through a gap or clearance between the preferably stationary draping device 23 and the conveyor 22. The manner in which the device **23*a* cooperates with the conveyor 22** to convert successive uniting bands into tubes which sealingly connect the respective filter plugs to the aligned plain cigarettes is disclosed, for example, in commonly owned U.S. Pat. No. 3,527,234 granted Sept. 8, 1970 to Alfred Hinzmann.

Finished filter cigarettes of double unit length are transferred into successive flutes of a rotary drum-shaped cooling conveyor 24 which delivers successive filter cigarettes of double unit length into the flutes of a rotary drum-shaped severing conveyor 26 cooperating with a rotary disk-shaped knife **26*a* to subdivide each filter cigarettes of double unit length into two filter cigarettes of unit length. The knife 26*a* severs the strip-shaped portions of successive tubes, i.e., those portions of convoluted uniting bands which are coated with adhesive. This ensures that the knife 26*a* is not contaminated with adhesive. The cooling conveyor 24 can constitute a hollow drum-shaped body and may be associated with means for circulating a liquid or gaseous coolant through its interior. The main purpose of the conveyor 24 is to guarantee rapid setting of those portions of successive tubes which overlap each other, i.e., which form seams extending in the axial direction of the respective filter cigarettes of double unit length and which are most likely to open due to tendency (or eventual tendency) of convoluted uniting bands to reassume their flat or substantially flat shape. It is preferred to transfer successive filter cigarettes of double unit length from the draping conveyor 22 onto the cooling conveyor 24 in such a way that the aforementioned seams of the tubes enter the flutes of the conveyor 24** and are thus in direct contact with the cooled surfaces surrounding the respective flutes.

The severing conveyor 26 delivers pairs of coaxial filter cigarettes of unit length (hereinafter called cigarettes for short) into successive flutes of a rotary drum-shaped conveyor 27 forming part of a turn-around device 29 of the type disclosed in commonly owned U.S. Pat. No. 3,583,546 granted June 8, 1971 to Gerhard Koop. The turn-around device 29 further comprises a second rotary drum-shaped conveyor **27*a* which has peripheral flutes receiving one cigarette of each pair of cigarettes in the flutes of the conveyor 27. The conveyor 27 delivers the non-removed cigarettes into alternate flutes of a third rotary drum-shaped conveyor 28 of the turn-around device 29. The cigarettes which are delivered by the flutes of the conveyor 27*a* are attracted to the upper portions of orbiting arms 29*a* which transport the respective cigarettes along an arc of 180 degrees and insert the inverted cigarettes into the oncoming flutes of a further rotary drum-shaped conveyor 28*a* of the device 29. The conveyor 28*a* delivers the inverted cigarettes into the empty flutes of the conveyor 28** so that each flute of this conveyor contains a cigarette and the filter tips of all cigarettes face in the same direction. Such cigarettes preferably form a row wherein each preceding cigarette is in accurate register with the next-following cigarette.

Successive cigarettes on the conveyor 28 are transferred onto a rotary drum-shaped testing conveyor 31 whereon the wrappers of the cigarettes are tested for the presence or absence of leaks, open seams, frayed ends and/or other defects. Successive tested cigarettes are transferred onto an ejecting conveyor 32 which cooperates with a pneumatic ejector nozzle (not shown) serving to segregate defective cigarettes from satisfactory cigarettes in a manner well known from the art of cigarettes testing, and the satisfactory cigarettes are transferred onto the upper reach of a belt conveyor 36 which delivers satisfactory cigarettes to storage or directly into the magazine of a packer, not shown. If desired, the conveyor 32 may form part of a device which tests the tobacco-containing ends or heads of cigarettes for density, and the cigarettes having defective heads can be ejected at the station at which the aforementioned ejecting nozzle segregates cigarettes having defective wrappers. The belt conveyor 36 is trained over pulleys or rollers 34 one of which is shown in FIG. 1. The illustrated roller or pulley 34 cooperates with a braking drum 33 for satisfactory cigarettes.

The frame F further supports a second spindle 114*a* for a fresh bobbin 14*a* containing a convoluted spare web 13' of cigarette paper, imitation cork or the like. When the supply of running web 13 is nearly exhausted, a suitable sensor (not shown) transmits a signal to a splicing device at a splicing station SPL. The splicing device attaches the leader of the spare web 13' to the web 13 and severs the web 13 behind the thus obtained splice. Reference may be had to commonly owned U.S. Pat. No. 3,730,811 granted May 1, 1973 to Hans-Joachim Wendt which discloses a suitable splicing device.

The paster 18 further comprises a trough 37 which is located below the tank 18*a* and serves to intercept droplets (if any) of adhesive which are not applied to the running web 13. The apparatus of the present invention comprises a housing 38 which constitutes a guide for the web 13 and is installed in the frame F at a level below the trough 37. The housing 38 defines a slot-shaped passage 48 (FIGS. 3 and 4) through which successive increments of the web 13 advance, and the passage has an inlet 48*a* and an outlet 48*b*. The means for directing the web 13 into the passage 48 at the inlet 48*a* comprises a guide roll 39, and the means for directing successive increments of the web 13 toward the applicator 18*c* of the paster 18 after such increments issue from the passage 48 includes a guide rail 41.

Figure 2:
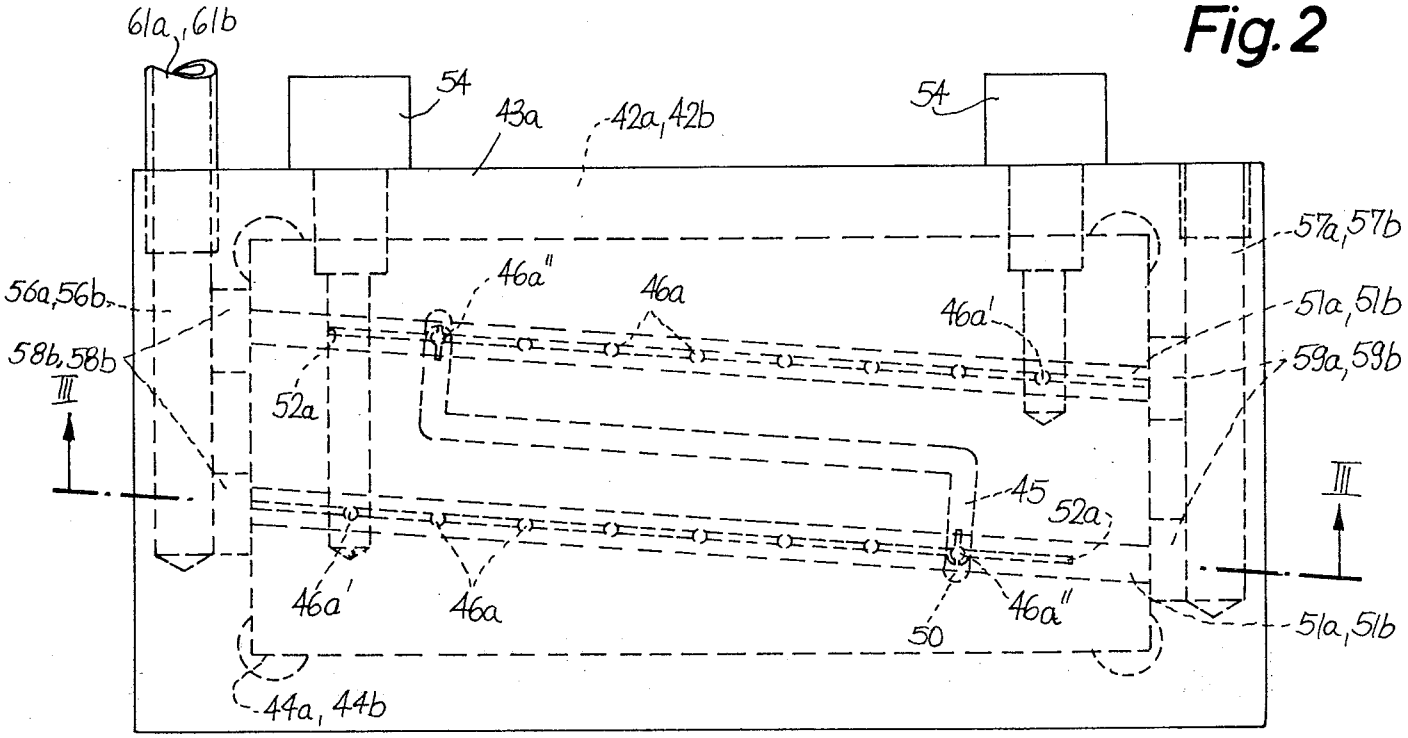
FIG. 2 is an enlarged plan view of the apparatus as seen in the direction of arrow II in FIG. 1 or 3.
Figure 3:
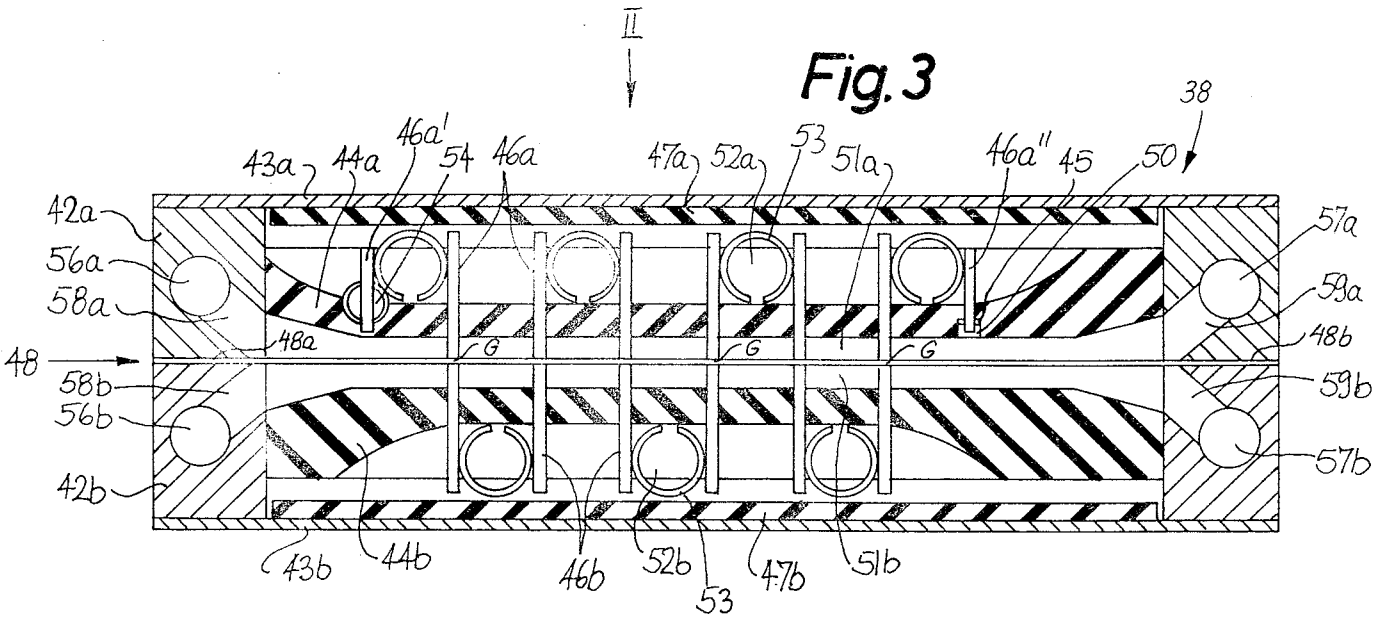
FIG. 3 is a longitudinal vertical sectional view of the apparatus as seen in the direction of arrows from the line III—III of FIG. 2.

As shown in FIGS. 2 and 3, the housing 38 comprises two frame members 42*a*, 42*b*, which constitute the end portions and side walls of the housing and define the aforementioned inlet 48*a* and outlet 48*b*, a plate-like top wall 43*a*, a plate-like bottom wall 43*b*, two electrode holders 44*a* and 44*b* which consist of an electrically insulating material (e.g., a suitable ceramic substance) and support pairs of electrodes 46*a*, 46*b*, and two plate-like cover members 47*a*, 47*b* which are respectively adjacent to the inner sides of the walls 43*a*, 43*b* and also consist of an electrically insulating material (e.g., the aforementioned ceramic of which the holders 44*a* and 44*b* are made).

The frame members 42*a*, 42*b* and the top and bottom walls 43*a*, 43*b* are secured to each other by screws or other suitable fastener means (not shown) and define a compartment which confines the electrode holders 44*a* and 44*b*. The frame members 42*a*, 42*b* are provided or connected with suitable distancing members (not specifically shown here but fully disclosed and shown in the aforementioned copending application Ser. No. of Peter Pinck et al.) which ensure that the housing 38 defines the aforementioned passage 48 for the web 13. The passage 48 is defined by two mirror symmetrical recesses which are formed in the inner sides of the frame members 42*a*, 42*b* and the slot 48 extends along the full length of the housing 38 to ensure that the web 13 advances between the upper electrodes 46*a* (shown in each of FIGS. 2–4) and the lower electrodes 46*b* (shown in FIGS. 3 and 4). The plate-like insulating covers 47*a* and 47*b* are preferably bonded (e.g., adhesively secured) to the walls 43*a* and 43*b*.

Those surfaces of the electrode holders 44*a* and 44*b* which are adjacent to the slot 48 (i.e., which face the web 13 when the latter is running through the housing 38) are formed with pairs of first or inner recesses in the form of grooves 51*a* and 51*b*. The inner end portions of the electrodes 46*a* and 46*b* respectively project into the grooves 51*a* and 51*b*, and each inner end portion of an electrode 46*a* defines with the inner end portion of the associated electrode 46*b* a spark gap G (see FIG. 3).

Those surfaces of the electrode holders 44*a* and 44*b* which face away from the slot 48 are also provided with pairs of recesses in the form of narrow slits 52*a* and 52*b* for the outer end portions of the respective electrodes 46*a* and 46*b*. The outer end portions of the electrodes 46*a* and 46*b* are mechanically secured to the respective holders 44*a* and 44*b* by elastic rings 53. Furthermore, each ring 53 establishes an electrical connection between a pair of longitudinally aligned electrodes 46*a* or 46*b* (see FIG. 3).

The electrode 46*a'* at the forward (left-hand) end of the front or lower row of electrodes 46*a* and the electrode 46*a'* at the rear (right-hand) end of the rear or upper row of electrodes 46*a* (as viewed in FIG. 2) serve soley to establish electrical connections, i.e., their inner end portions do not project all the way into the grooves 51*a* of the respective (upper) electrode holder 44*a*. Instead, the electrodes 46*a'* are connected with terminal sleeves 54 which extend from the housing 38 (see FIG. 2). Analogously, the electrodes 46*a''* at the other ends of the front and rear rows of electrodes 46*a* do not extend into the grooves 51*a* but merely serve to connect the two rows of electrodes 46*a* to each other by way of a conductor 45 which is inserted into a channel 50 of the electrode holder 44*a*.

The frame members 42*a* and 42*b* are respectively formed with bores 56*a*, 57*a* and 56*b*, 57*b* which serve to allow for circulation of air through the slot 48. More specifically, the bores 56*a*, 57*a* are connected with the grooves 51*a* by pairs of connecting channels 58*a*, 59*a* which are respectively located one behind the other (as viewed in FIG. 1 or 3), and the bores 57*a*, 57*b* are connected with the grooves 51*b* by pairs of connecting channels 58*b*, 59*b* which, too, are respectively disposed one behind the other. In other words, each groove 51*a* or 51*b* communicates with two bores (56*a* and 57*a* or 56*b*, 57*b*). The bores 56*a* and 56*b* are connected with the suction intake of a blower 62 (shown in FIG. 4) by a conduit 61 which branches into two lines 61*a* and 61*b* (FIG. 2). The bores 57*a* and 57*b* communicate with the atmosphere.

Figure 4:
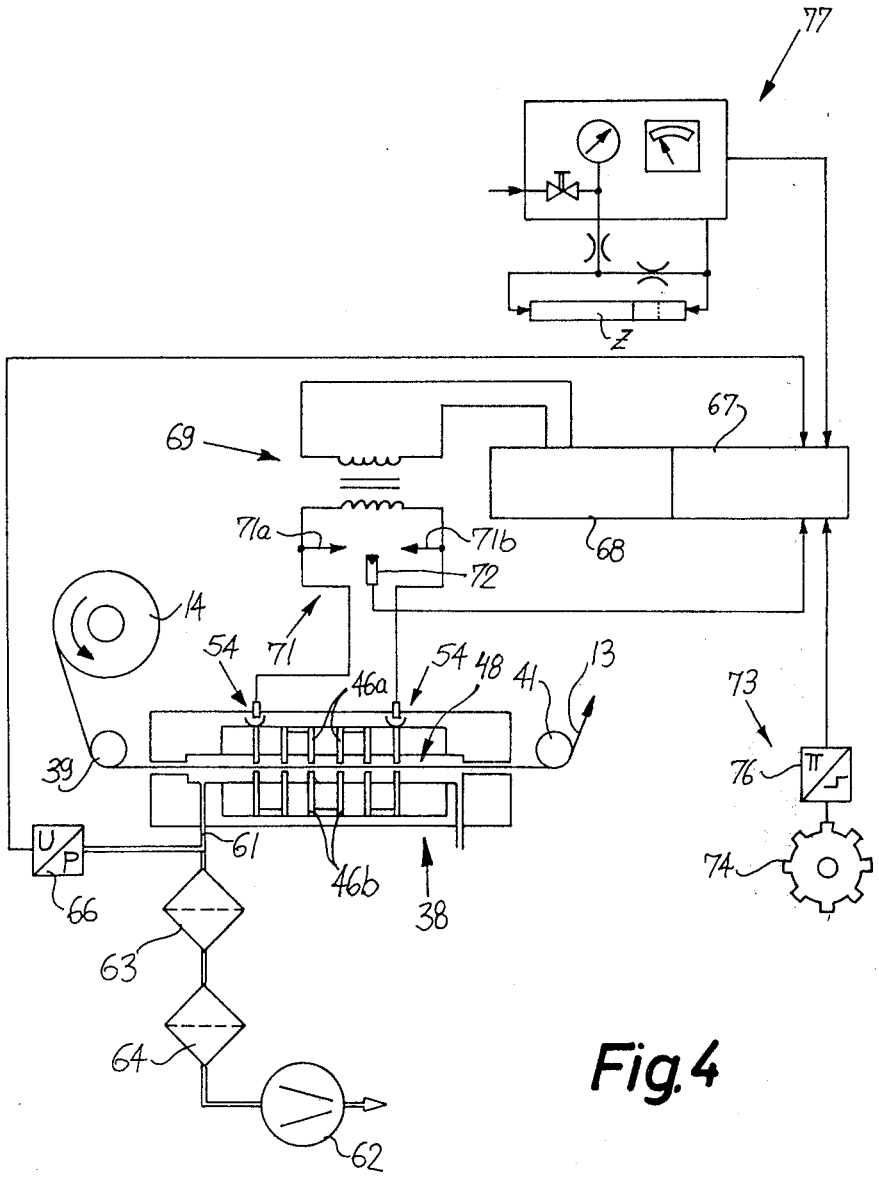
FIG. 4 is a smaller-scale schematic front elevational view of the apparatus and of the associated control and regulating means.

As shown in FIG. 4, the conduit 61 (which connects the slot 48 of the housing 38 with the suction intake of the suction generating blower 62) further contains a dust filter 63 (e.g., a suitably modified version of a suction line filter of the type used in automotive vehicles) which is installed upstream of the blower 62, as considered in the direction of air flow through the conduit 61. Still further, the conduit 61 contains an ozone filter 64 which is installed between the dust filter 63 and the blower 62. For example, the ozone filter 64 may be a filter of the type containing activated charcoal which can absorb ozone. Furthermore, the conduit 61 is connected with a pressure monitoring device 66 here shown as a pressure responsive switch which is located upstream of the dust filter 63 and can generate electric signals denoting the pressure of air in the respective portion of the conduit 61. For example, the switch 66 may constitute a diaphragm type transducer, namely, a transducer which connects pneumatic signals (denoting the pressure in the conduit 61) into electric signals having the corresponding intensity or another characteristic. The switch 66 transmits electric signals to a control unit 67 which regulates the operation of a switching circuit 68. The circuit 68 is connected with the primary winding of a source 69 of high-voltage impulses here shown as a transformer whose secondary winding is connected with the sleeve-like terminals 54, i.e., with the two rows of series-connected electrodes 46*a*.

The apparatus further includes an electrode pair 71 which includes two spaced apart additional or auxiliary electrodes 71*a*, 71*b* connected in parallel with the electrodes 46*a*. The distance between the electrodes 71*a* and 71*b* is normally greater than the sum of distances between the pairs of electrodes 46*a* and 46*b*, and such distance (namely, that between the electrodes 71*a* and 71*b*) is selected in such a way that it corresponds to the permissible wear (due to burning) upon the electrodes 46*a* and 46*b*. A spark will jump across the gap between the electrodes 71*a* and 71*b* when the extent of wear upon the electrodes 46*a* and 46*b* has progressed to such an extent that it equals the maximum permissible value. The just mentioned spark is detected by a photoelectric monitoring device 72 which transmits a signal to the control unit 67 whenever a spark is detected between the electrodes 71*a* and 71*b*.

The control unit 67 is further connected with a timing pulse generator 73 including a disk 74 which is driven by the prime mover PM of the filter tipping machine shown in FIG. 1. The disk 74 has one or more prongs or like components which travel past a proximity switch 76 serving to generate a pulse whenever approached by a prong. Still further, the control unit 67 is connected with a cigarette testing device 77 which generates signals denoting the rate of air flow through the wrappers of filter cigarettes Z which are manufactured in the filter tipping machine of FIG. 1. More specifically, the testing device 77 can ascertain the resistance which a filter cigarette offers to axial flow of a gaseous fluid therethrough, and such resistance is proportional to permeability of the respective wrapper if the density of the cigarette filler matches a preselected value.

The control unit 67 forms no part of the present invention. It is shown and described here solely for the sake of completeness of disclosure. A presently known control unit which can be utilized in the apparatus of FIG. 4 may comprise a comparator circuit or an analogous system which can compare the signals transmitted by the testing device 77 (and denoting the extent to which the wrappers of filter cigarettes Z are permeable to a gaseous fluid) with a reference signal (e.g., a signal furnished by an adjustable potentiometer or an analogous source of reference signals) denoting the desired or optimum permeability of cigarette wrappers. The control unit 67 may further comprise a multiplier circuit which is connected with the output of the comparator circuit and with the output of the proximity switch 76, as well as a trigger circuit for the switching circuit 68. Still further, the control unit 67 may comprise logic circuits of any known design which ensure that the signals which the testing device 77 transmits during acceleration of the filter tipping machine are suppressed, i.e., the testing device 77 can participate in the regulation of operation of the perforating apparatus only when the machine of FIG. 1 operates at the rated or nominal speed, namely, when the proximity switch 76 of the timing pulse generator 73 transmits pulses at a predetermined frequency. Still further, the control unit 67 may comprise one or more threshold circuits or analogous means which turn off the machine of FIG. 1 when its operating speed is reduced below a predetermined minimum permissible value. A control unit which can be used in the apparatus of FIG. 4 is disclosed, for example, in U.S. Pat. No. 3,385,951. A testing device which is suitable for use in the apparatus of FIG. 4 is disclosed, for example, in German Offenlegungsschrift No. 2,734,643. These publications can be referred to for further details of the respective constituents of the apparatus.

The operation of the apparatus which includes the housing 38 is as follows:

When the filter tipping machine of FIG. 1 is in use, the peripheral surface of the rotating suction drum 19 attracts the leader of the web 13 so that the latter is transported through the passage or slot 48 of the housing 38 in a direction from the roll 39 toward the roll 41. The transformer 69 transmits a succession of high voltage impulses each of which causes a current to flow from one of the electrodes 46*a*', through the respective ring 53, through the electrode 46*a* of one row which is immediately adjacent to the just mentioned electrode 46*a*', across the gap G between the electrode 46*a* and the associated electrode 46*b*, through the ring 53 between the just mentioned electrode 46*b* and the neighboring electrode 46*b*, across the gap G between such neighboring electrode and the aligned electrode 46*a*, and so forth all the way to the other electrode 46*a*'. Sparks which develop in the gaps G in response to transmission of each high voltage impulse burn holes in the running web 13. The pairs of aligned electrodes 46*a*, 46*b* are staggered with reference to each other, as considered transversely of the direction of travel of the web 13 from the roll 39 toward the roll 41, so that the web 13 is formed with numerous rows of holes, namely, with a discrete row for each pair of electrodes 46*a*, 46*b*. The manner in which the electrodes 46*a*, 46*b* are staggered is shown in FIG. 2. Reference may also be had to the commonly owned copending patent application Ser. No. 003,364 of Anton Baier, now U.S. Pat. No. 4,247,754 granted Jan. 27, 1980.

The motor (not specifically shown) for the suction generating blower 62 is on so that the blower draws a stream of cool air from the atmosphere, through the bores 57*a*, 57*b* at one end of the slot 48, through the slot 48, through the bores 56*a*, 56*b* at the other end of the slot 48, through the branches 61*a*, 61*b* and through the conduit 61. The thus formed stream of air flows through the grooves 51*a*, 51*b* and cools the inner end portions of the electrodes 46*a*, 46*b*. Moreover, the air stream which leaves the housing 38 via bores 56*a*, 56*b* entrains dust from the grooves 51*a*, 51*b*, i.e., from the regions which are adjacent to the gaps G, and such dust is intercepted by and retained in the filter 63. Ozone which develops as a result of the generation of sparks in the gaps G is entrained by the air stream which flows toward the intake of the blower 62, and the filter 64 ensures that the ozone does not reach the interior of the blower 62 and/or that ozone cannot flow back into the housing 38.

The quantity of air which flows from the intake end toward the discharge end of the conduit 61 is monitored by the pressure-responsive switch 66. Thus, the switch 66 indirectly ascertains whether or not the rate of air flow through the housing 38 and conduit 61 suffices to adequately cool the inner end portions of the electrodes 46*a*, 46*b*. When the pressure in the conduit 61 is unsatisfactory (e.g., when the pressure is unduly affected by dust which is intercepted by and accumulates in the dust filter 63), the switch 66 transmits an appropriate signal to the control unit 67 which interrupts the transmission of high voltage impulses from the transformer 69 to the electrodes 46*a*, 46*b*. Such interruption of transmission of high voltage impulses is automatically followed by or takes place simultaneously with stoppage of the filter tipping machine, i.e., the control unit 67 transmits a signal which arrests the prime mover PM of the filter tipping machine.

The auxiliary or additional electrodes 71*a*, 71*b* of the pair 71 monitor the degree of wear (burning) of the electrodes 46*a*, 46*b*. When the wear upon the electrodes 46*a*, 46*b* reaches a preselected maximum permissible value, the sum of distances between the electrode pairs 46*a*, 46*b* exceeds the distance (i.e., the width of the additional spark gap) between the electrodes 71*a*, 71*b*. Therefore, when the transformer 69 again transmits a high voltage impulse, such impulse causes the generation of a spark across the additional gap between the electrodes 71*a*, 71*b*. The spark is detected by the photoelectric monitoring device 72 which transmits an appropriate signal to the control unit 67. The latter then interrupts the transmission of high voltage impulses and also stops the prime mover PM of the filter tipping machine.

An important advantage of the improved apparatus is that the air stream which is caused to flow through the housing 38 and conduit 61 when the motor for the suction generating blower 62 is on brings about a highly desirable and effective cooling of the electrodes 46*a*, 46*b* so that the wear upon these electrodes is much less pronounced than in heretofore known apparatus wherein a web, sheet, strip or a like body of wrapping material is perforated by sparks. Moreover, the air stream continuously removes dust and ozone from the interior of the housing 38, and the filter 63 and 64 respectively ensure that neither dust nor ozone can enter the surrounding atmosphere. The placing of the ozone filter 64 between the suction intake of the blower 62 and the dust filter 63 is preferred at this time because the stream of air which flows in the conduit 61 is relieved of dust before it reaches the filter 64, i.e., the latter can stand long periods of uninterrupted use because its effectiveness is not adversely influenced by particles of dust. Moreover, and since the ozone filter 64 is located ahead or upstream of the blower 62 (as considered in the direction of air flow through the conduit 61), ozone is intercepted before it could enter into and corrode the constituents of the blower.

Another important advantage of the improved apparatus is that the discharge end of the conduit 61 is connected with the suction intake of the blower 62, i.e., that the apparatus operates with air which is sucked (rather than blown) through the housing 38. This is desirable and advantageous because the housing 38 need not be encapsulated in a manner as known from certain prior electrically operated perforating apparatus (reference may be had to German Offenlegungsschrift No. 2,833,527 which discloses an apparatus wherein the perforating means includes electrodes and means for cooling the electrodes by compressed air which also serves to remove dust from the regions of the spark gaps). Encapsulation is necessary for proper operation with compressed air, i.e., it is necessary to seal the interior of the housing for the electrodes from the surrounding atmosphere. This invariably involves considerable initial and maintenance cost, especially for adequate sealing in the regions where the web enters and leaves the housing for the electrodes. Still further, encapsulation of the housing for the electrodes would render it more difficult to gain access to certain component parts and/or to carry out certain operations which must be performed from time to time. For example, threading of the leader of a web through the housing 38 would be much more difficult if the housing 38 were confined in an airtight enclosure or if the housing were designed to constitue an airtight confining body for the electrodes 46*a*, 46*b*. Similar problems would arise whenever an attendant would have to gain access to the electrodes 46*a* and/or 46*b* for the purpose of inspection and/or replacement.

The pressure monitoring switch 66 exhibits the advantage that the degree to which the electrodes 46*a* and 46*b* are cooled by the stream of atmospheric air which flows into the intake end of the conduit 61 can be monitored in a fully automatic way and that the operator or operators can be warned (either by stoppage of the filter tipping machine or in another suitable way) whenever the cooling of electrodes is unsatisfactory, i.e., when the cooling action is insufficient to ensure a relatively long useful life of the electrodes and/or to prevent charring or combustion of the running web 13. As shown in FIG. 4, the connection between the conduit 61 and the switch 66 is located upstream of the dust filter 63. This enables the switch 66 to ascertain whether or not the filter 63 is sufficiently clogged to warrant replacement or cleaning, i.e., whether or not the filter 63 offers excessive resistance to the flow of adequate quantities of air therethrough. The reaction of the control unit 67 to a signal from the switch 66 is preferably immediate, i.e., the transformer 69 ceases to transmit high voltage impulses and the filter tipping machine (or any other machine which serves for the manufacture and/or processing of rod-shaped articles constituting or forming part of smokers' products and wherein the improved apparatus is installed) is brought to an immediate stop before the wear upon the electrodes 46*a*, 46*b* begins to progress at an excessive rate as a result of inadequate cooling. Inadequate cooling of electrodes 46*a*, 46*b* not only results in excessive wear upon the electrodes but is also likely to overheat the entire apparatus and to thus damage the web 13 which is drawn through the passage or slot 48 by the suction drum 19 or an analogous web advancing or transporting means.

The likelihood of charring of the web 13 in the interior of the housing 38 is reduced due to the fact that the inner end portions of both sets of electrodes (46*a* and 46*b*) extend into grooves (51*a*, 51*b*) in the inner surfaces of the respective holders 44*a*, 44*b* and that such grooves also communicate with the bores 56*a*, 56*b* and 57*a*, 57*b*, i.e., the blower 62 can draw cool atmospheric air into each of the just mentioned grooves which are disposed at the opposite sides of the path of movement of the web 13 through the housing 38. Therefore, the (subatmospheric) pressure at the upper side of the path for the web 13 is indentical with the pressure at the underside of the web so that the electrode 46*a* and 46*b* (whose inner end portions are often quite hot, i.e., they are often heated to glowing temperature) are highly unlikely to contact the running web which passes through the slot 48. The likelihood of contact between the web 13 and the electrodes 46*a* or 46*b* would be much more pronounced if the pressure at one side of the web were different from the pressure at the other side of the web. The cross-sectional area of the grooves 51*a* in the inner surface of the holder 44*a* (namely, in that surface which faces the upper side of the web 13 in the interior of the housing 38) is preferably identical with the cross-sectional area of grooves 51*b* in the inner surface or side of the holder 44*b* (namely, in that surface of the holder 44*b* which faces the underside of the web 13 in the housing 38). It has been found that, if the holders 44*a* and 44*b* are designed and mounted in a manner as described above, the web 13 in the housing 38 actually "floats" between but does not contact the electrodes 46*a* and/or 46*b* even though the gaps G are relatively narrow. This is due to the fact that the air stream which flows through the housing 32 from the bores 57*a*, 57*b* toward the bores 56*a*, 56*b* is halved by the running web 13 and forms two partial streams whose pressure, rate of flow and other characteristics are identical.

An additional important advantage of the improved apparatus is that it can alert the attendants if and when the electrodes 44*a* and/or 46*b* must be adjusted and/or replaced as a result of pronounced or excessive wear. This is accomplished by the provision of the aforementioned additional or auxiliary electrodes 71*a*, 71*b* and monitoring device 72 which monitors the presence or absence of sparks in the (additional) gap between the electrodes 71*a*, 71*b*, i.e., which transmits to the control 67 signals whenever the need for an inspection, adjustment or replacement of electrodes 46*a* and/or 46*b* arises. The electrodes 46*a* and 46*b* are respectively connected in series by the conductive rings 53, and the additional electrodes 71*a*, 71*b* are connected in parallel with the electrodes 46*a*. Such very simple but highly reliable and effective arrangement renders it possible to equip the apparatus with a compact and inexpensive monitoring system which ascertains the degree of wear upon the electrodes 46*a* and/or 46*b* and can warn the attendants in good time before the perforating apparatus begins to operate in an unsatisfactory way due to excessive wear upon the perforating electrodes. For example, each signal which is transmitted by the monitoring device 72 in response to detection of a spark in the gap between the electrodes 71*a* and 71*b* can cause the control unit 67 to complete the circuit of a signal lamp, a horn and/or another suitable warning device, not shown. Such visual and/or audible signals can be generated in addition to interruption of transmission of impulses from the transformer 69 and/or in addition to automatic stoppage of the machine in which the improved apparatus is installed. Stoppage of the machine when the wear upon the electrodes 46*a* and/or 46*b* is excessive is desirable and advantageous because such arrangement ensures that the machine cannot turn out cigarettes or other rod-shaped articles constituting or forming part of smokers' products wherein the degree of ventilation (i.e., permeability) of the wrappers deviates from an optimum value or is outside of an acceptable range of permeabilities.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of our contribution to the art and, therefore, such adaptations should and are intended to be comprehended within the meaning and range of equivalence of the appended claims.

We claim:

1. Apparatus for making holes in a running web of wrapping material in a machine for the manufacture and/or processing of cigarettes or other rod-shaped articles which constitute or form part of smokers' products, comprising a housing defining a passage for the running web; means for transporting the web through said housing; first and second electrode means installed in said housing and defining at least one spark gap forming part of said passage so that the running web advances through said gap; means for applying high voltage impulses to said electrode means and for thereby inducing the flow of a current across said gap with attendant generation of sparks which burn holes in the running web and cause the development of dust and ozone; means for drawing a stream of atmospheric air through said passage whereby the stream cools the electrode means and removes dust and ozone from said passage, including conduit means having an intake end communicating with said passage and a discharge end and suction generating means connected to said discharge end; dust intercepting means installed in said conduit means; and ozone separating means installed in said conduit means.

2. The apparatus of claim 1, wherein said ozone separating means is disposed between said dust intercepting means and said suction generating means.

3. The apparatus of claim 1, wherein said ozone separating means comprises an activated charcoal filter.

4. The apparatus of claim 1, further comprising means for monitoring the pressure of the air stream in said conduit means.

5. The apparatus of claim 4, wherein said ozone separating means is disposed between said dust intercepting means and said suction generating means, said monitoring means being arranged to determine the pressure of air in said conduit means intermediate said intake end and said dust intercepting means.

6. The apparatus of claim 4, wherein said means for applying high voltage impulses comprises a source of high voltage and further comprising control means operatively connected with said source and said monitoring means and operative to interrupt the application of impulses to said electrode means when the monitored pressure of air in said conduit means is outside of a predetermined range.

7. The apparatus of claim 1, wherein said housing comprises first and second electrode holders at the opposite sides of said passage and said first and second electrode means respectively include several first and several second electrodes which are respectively installed in said first and second holders, each of said first electrodes defining a spark gap with a different one of said second electrodes, said holders having surfaces adjacent to said passage and each of said surfaces having at least one recess for those portions of the corresponding electrodes which define the respective gaps, said recesses being in communication with said intake end so that said conduit means draws air from the atmosphere and along both sides of the web which is transported through said passage.

8. The apparatus of claim 7, wherein the cross-sectional area of the recess in one of said holders at least closely approximates the cross-sectional area of the recess in the other of said holders.

9. The apparatus of claim 1, wherein said electrode means comprise at least one row of series-connected electrodes at one side of said passage and further comprising a pair of auxiliary electrodes connected in parallel with the electrodes of said row and defining an additional spark gap having a width exceeding the width of said first mentioned gap.

10. The apparatus of claim 9, further comprising means for monitoring said additional spark gap and for generating signals in response to detection of a spark in said additional spark gap, such spark developing in response to pronounced wear upon the electrodes of said first and second electrode means.

11. The apparatus of claim 10, wherein said monitoring means includes a photoelectric transducer.

12. The apparatus of claim 10, wherein said means for applying high voltage impulses comprises a high voltage source and further comprising control means operatively connected with said source and said monitoring means and arranged to interrupt the transmission of impulses in response to transmission of a signal from said monitoring means.

13. The apparatus of claim 1, wherein said passage is elongated and said housing includes at least one opening communicating with the atmosphere and with one end of said passage, said intake end communicating with the other end of said passage.

* * * * *